US008136810B1

(12) United States Patent
Wang et al.

(10) Patent No.: US 8,136,810 B1
(45) Date of Patent: Mar. 20, 2012

(54) SHEET ALIGNMENT AND EJECTION MECHANISM

(75) Inventors: Ching-Tse Wang, Taipei (TW); Chung-Kai Wang, Taipei (TW); Ming-Han Chiu, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 13/159,636

(22) Filed: Jun. 14, 2011

(30) Foreign Application Priority Data

Apr. 15, 2011 (TW) ..... 100113132

(51) Int. Cl.
*B65H 31/26* (2006.01)

(52) U.S. Cl. ..... 271/220; 271/189; 399/407; 270/58.12

(58) Field of Classification Search ..... 271/220, 271/221, 189–191; 399/407; 270/58.12, 270/58.16, 58.17, 58.27
See application file for complete search history.

(56) References Cited

U.S. PATENT DOCUMENTS 5,626,333 A * 5/1997 Chung et al. ..... 270/58.12
6,601,846 B2 * 8/2003 Saito et al. ..... 271/221
7,461,837 B2 * 12/2008 Saito et al. ..... 270/58.12
7,823,868 B2 11/2010 Taki et al.
7,832,725 B2 * 11/2010 Hosoya et al. ..... 271/220
2004/0251608 A1 * 12/2004 Saito et al. ..... 271/220

* cited by examiner

*Primary Examiner* — Gerald McClain

(74) *Attorney, Agent, or Firm* — Kirton McConkie; Evan R. Witt

(57) ABSTRACT

A sheet alignment and ejection mechanism includes a sheet alignment device, a sheet ejection device, a power device and a transmission unit. The sheet alignment device includes a first one-way element. The sheet ejection device includes a second one-way element. The transmission unit includes plural gears. The transmission unit is connected with the power device, the first one-way element and the second one-way element for driving rotation of the first one-way element and the second one-way element. The first one-way element and the second one-way element are rotated in opposite directions. When the first one-way element is rotated in a first direction, the sheets aligned on a sheet placement tray are aligned by the sheet alignment device. When the second one-way element is rotated in the first direction, the stapled sheets are ejected out of the sheet placement tray by the sheet ejection device.

8 Claims, 11 Drawing Sheets

SHEET ALIGNMENT AND EJECTION MECHANISM

FIELD OF THE INVENTION

The present invention relates to a sheet alignment and ejection mechanism, and more particularly to a sheet alignment and ejection mechanism for use in an office machine.

BACKGROUND OF THE INVENTION

An office machine such as a printer or a scanner is widely used in the office. For achieving diversified functions and integrating more functions, the office machine is usually equipped with a post-processing device (e.g. a stapler). By the stapler, plural documents outputted from the printer or the scanner can be automatically stapled in order to enhance the working efficiency. The operations of the post-processing device (e.g. a stapler) will be illustrated as follows. Firstly, the documents are placed on a sheet placement tray. Then, the edges of these documents are aligned with each other by a sheet alignment device. Then, a stapling operation is performed by the stapler, so that the corresponding parts of these documents are combined together. Afterwards, the stapled documents are ejected from the sheet placement tray to the outer portion of the office machine through a sheet ejection device. In other words, it is necessary to install the sheet alignment device to align the document with each other and install the sheet ejection to automatically eject the stapled documents.

Please refer to FIGS. 1A~1D. FIG. 1A is a schematic perspective view illustrating a sheet alignment device of a conventional sheet alignment and ejection mechanism. FIG. 1B is a schematic perspective view illustrating the conventional sheet alignment and ejection mechanism applied to an office machine. FIG. 1C is a schematic perspective view illustrating a sheet ejection device of the conventional sheet alignment and ejection mechanism, in which the sheet ejection device is in a standby status. FIG. 1D is a schematic perspective view illustrating a sheet ejection device of the conventional sheet alignment and ejection mechanism, in which the sheet ejection device is in a sheet-ejecting status. The conventional sheet alignment and ejection mechanism shown in FIGS. 1A-1D is disclosed in for example U.S. Pat. No. 7,823,868.

The conventional sheet alignment and ejection mechanism 1 comprises a sheet alignment device 11, a sheet ejection device 12, a sheet placement tray 13 and a post-processing unit (not shown). As shown in FIGS. 1A and 1B, the sheet alignment device 11 comprises plural paddles 11*a*, a first rotation shaft 11*b* and a first power device 11*c*. As shown in FIGS. 1C and 1D, the sheet ejection device 12 comprises a pushing part 12*a*, a ring-shaped conveyor belt 12*b*, a roller 12*c* and a second power device 12*d*. The sheet placement tray 13 comprises plural supporting arms 13*a*. The post-processing unit is for example a stapler.

Please refer to FIG. 1B. The first rotation shaft 11*b* is disposed above the sheet placement tray 13. The paddles 11*a* are sheathed around the first rotation shaft 11*b*. The first power device 11*c* is connected with the first rotation shaft 11*b*. Please refer to FIGS. 1C and 1D. The roller 12*c* is disposed under the sheet placement tray 13. The pushing part 12*a* is protruded from an outer surface of the ring-shaped conveyor belt 12*b*. The ring-shaped conveyor belt 12*b* is sheathed around the outer periphery of the roller 12*c* to enclose the sheet placement tray 13. The second power device 12*d* is connected with the roller 12*c*.

Hereinafter, the operations of the conventional sheet alignment and ejection mechanism will be illustrated with reference to FIGS. 1A-1D and also FIG. 1E. FIG. 1E is a schematic side view illustrating the conventional sheet alignment and ejection mechanism. Firstly, the sheet alignment device 11 and the sheet ejection device 12 are located at the home positions. As shown in the drawings, the paddles 11*a* of the sheet alignment device 11 are oriented upwardly and distant from the sheet placement tray 13, and the pushing part 12*a* is disposed under the roller 12*c*. When a sheet S is ready to be introduced to the sheet placement tray 13, the sheet S firstly falls down to the paddles 11*a*. Then, the first rotation shaft 11*b* and the paddles 11*a* are driven by the first power device 11*c* to be rotated in the direction d. As the paddles 11*a* are rotated, the sheet S falls down to the sheet placement tray 13, and then the sheet S is leant against a supporting arm 13*a* of the sheet placement tray 13. The first rotation shaft 11*b* and the paddles 11*a* are continuously rotated in the direction d until plural sheets S are leant against the supporting arm 13*a* of the sheet placement tray 13 and aligned with each other.

After the sheet alignment operation is completed, the plural sheets S on the sheet placement tray 13 are stapled by the post-processing unit. Then, the roller 12*c* is driven by the second power device 12*d* to be rotated in the direction d, and thus the ring-shaped conveyor belt 12*b* is rotated in the direction d. Consequently, the pushing part 12*a* is moved upwardly from the position under the roller 12*c* to the sheet placement tray 13. The pushing part 12*a* is linearly moved on the surface of the sheet placement tray 13 until the stapled sheets S are ejected out of the sheet placement tray 13.

From the above discussions, in the conventional sheet alignment and ejection mechanism 1, the operations of the sheet alignment device 11 and the sheet ejection device 12 are respectively controlled by the first power device 11*c* and the second power device 12*d*.

However, the conventional sheet alignment and ejection mechanism 1 still has some drawbacks. As previously described, since two power devices are employed to control the sheet alignment device and the sheet ejection device, a bulky internal space of the office machine is necessary. Under this circumstance, the fabricating cost of the office machine is increased.

Therefore, there is a need of providing an improved sheet alignment and ejection mechanism so as to obviate the drawbacks encountered from the prior art.

SUMMARY OF THE INVENTION

The present invention provides a sheet alignment and ejection mechanism by using a single power device to drive the sheet alignment device and the sheet ejection device.

In accordance with an aspect of the present invention, there is provided a sheet alignment and ejection mechanism for use in an office machine. The sheet alignment and ejection mechanism includes a sheet alignment device, a sheet ejection device, a power device and a transmission unit. The sheet alignment device includes at least one paddle, a first one-way element and a first rotation shaft. The first one-way element includes an alignment gear. The first one-way element is sheathed around the first rotation shaft. The paddle is attached on the first rotation shaft. When the first one-way element is rotated in a first direction, the first rotation shaft and the paddle are driven by the first one-way element to be rotated in the first direction. Whereas, when the first one-way element is rotated in a second direction, the first rotation shaft and the paddle are immobile. The sheet ejection device includes at least one sheet ejection assembly, a second one-way element and a second rotation shaft. The second one-way element includes a sheet ejection gear. The second one-way element is sheathed around the second rotation shaft. When the second one-way element is rotated in the first direction, the second rotation shaft and the sheet ejection gear are driven by the second one-way element to be rotated in the first direction. Wherein, when the second one-way element is rotated in the second direction, the second rotation shaft and the sheet ejection gear are immobile. The power device includes a driving gear. The driving gear is driven by the power device to be rotated in either the first direction or the second direction. The transmission unit includes plural gears. The plural gears are connected with the power device, the first one-way element and the second one-way element for driving rotation of the first one-way element and the second one-way element. The first one-way element and the second one-way element are rotated in opposite directions.

In an embodiment, the transmission unit includes a first gear, a second gear, a third gear and a fourth gear. The first gear is connected with the alignment gear of the first one-way element and the second gear. The second gear is connected with the driving gear of the power device, the first gear and the third gear. The third gear is connected with the second gear and the fourth gear. The fourth gear is connected with the third gear and the sheet ejection gear of the second one-way element.

In an embodiment, when the driving gear is driven by the power device to be rotated in the first direction, the first one-way element is rotated in the second direction and the second one-way element is rotated in the first direction.

In an embodiment, when the driving gear is driven by the power device to be rotated in the second direction, the first one-way element is rotated in the first direction and the second one-way element is rotated in the second direction.

In an embodiment, the sheet ejection device further includes a third rotation shaft, and the sheet ejection assembly includes at least one pushing part, a first belt pulley, a second belt pulley and a ring-shaped conveyor belt. The third rotation shaft is parallel with the second rotation shaft. The first belt pulley and the second belt pulley are respectively sheathed around the second rotation shaft and the third rotation shaft. The pushing part is protruded from an outer surface of the ring-shaped conveyor belt. The outer peripheries of the first belt pulley and the second belt pulley are enclosed by the ring-shaped conveyor belt.

In an embodiment, the sheet alignment and ejection mechanism further includes a first sensor and a first interrupter. The first sensor is disposed beside the ring-shaped conveyor belt of the sheet ejection assembly. The first interrupter is pivotally coupled to the first sensor and protruded under the ring-shaped conveyor belt. The first sensor and the first interrupter are collectively operated to detect whether the pushing part is at a home position.

In an embodiment, the sheet alignment and ejection mechanism further includes a second sensor and a second interrupter. The second interrupter is sheathed around the first rotation shaft. The second sensor is disposed over the second interrupter. The second sensor and the second interrupter are collectively operated to detect the number of times the first rotation shaft of the sheet alignment is rotated.

In an embodiment, the first one-way element and the second one-way element are one-way clutches.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a sheet alignment and ejection mechanism. The sheet alignment and ejection mechanism can be applied to an office machine.

Figure 1A:
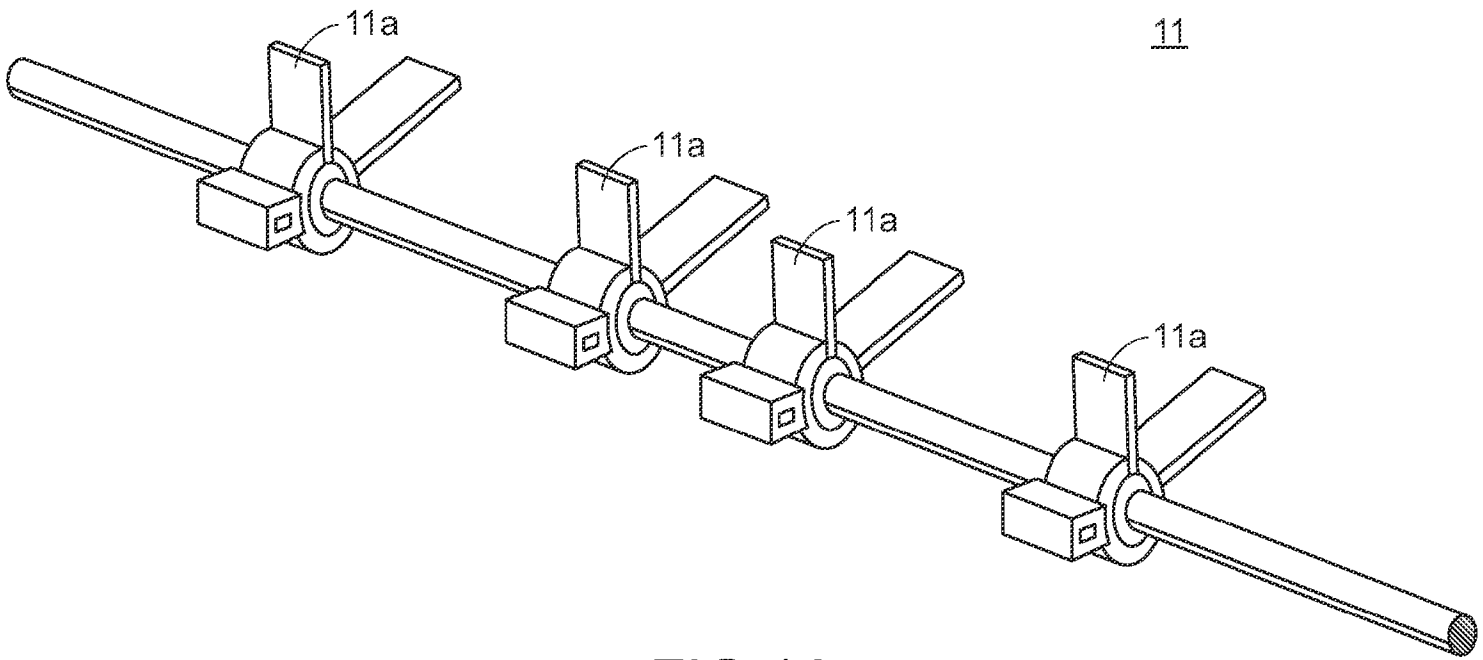
FIG.1A PRIOR ART
FIG. 1A is a schematic perspective view illustrating a sheet alignment device of a conventional sheet alignment and ejection mechanism.
Figure 1B:
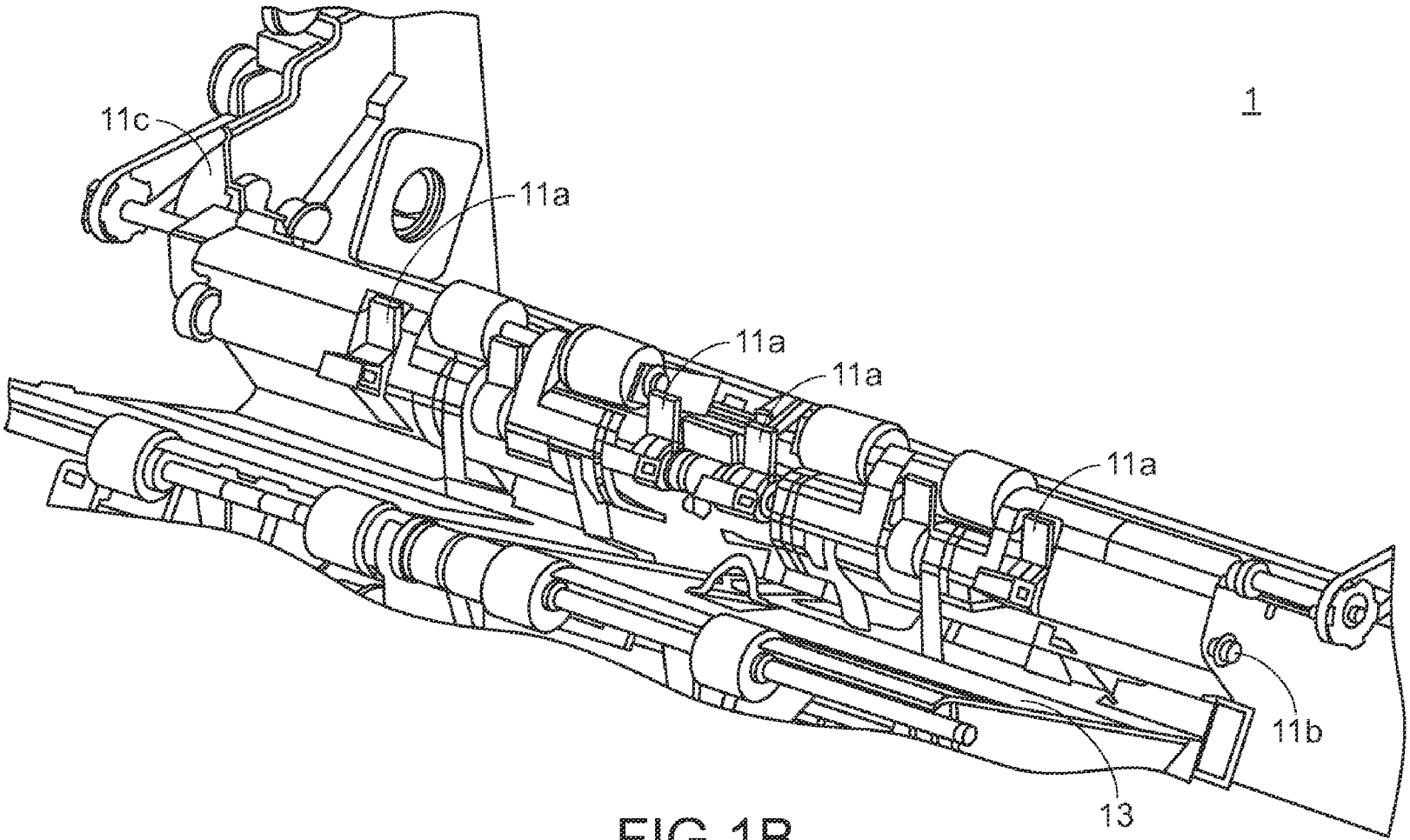
FIG.1B PRIOR ART
FIG. 1B is a schematic perspective view illustrating the conventional sheet alignment and ejection mechanism applied to an office machine.
Figure 1C:
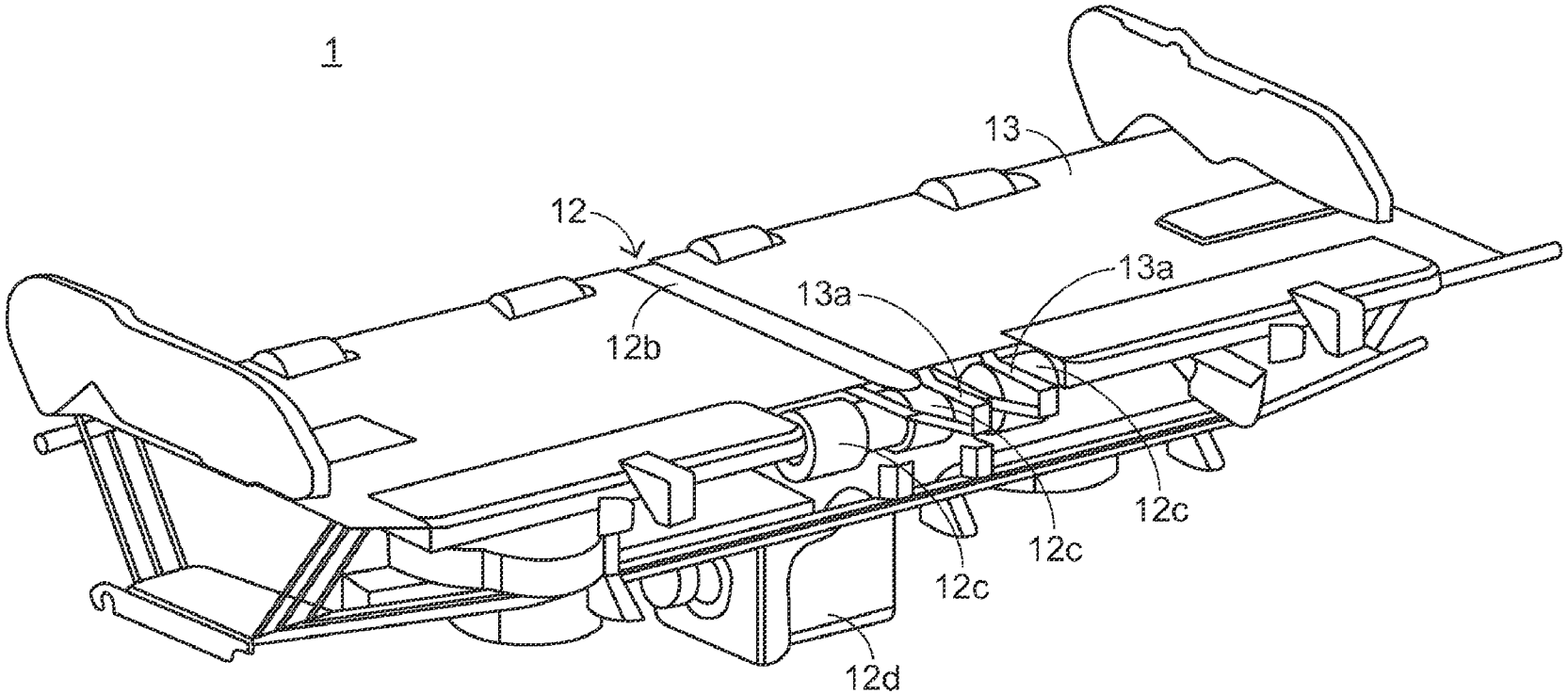
FIG. 1C PRIOR ART
FIG. 1C is a schematic perspective view illustrating a sheet ejection device of the conventional sheet alignment and ejection mechanism, in which the sheet ejection device is in a standby status.
Figure 1D:
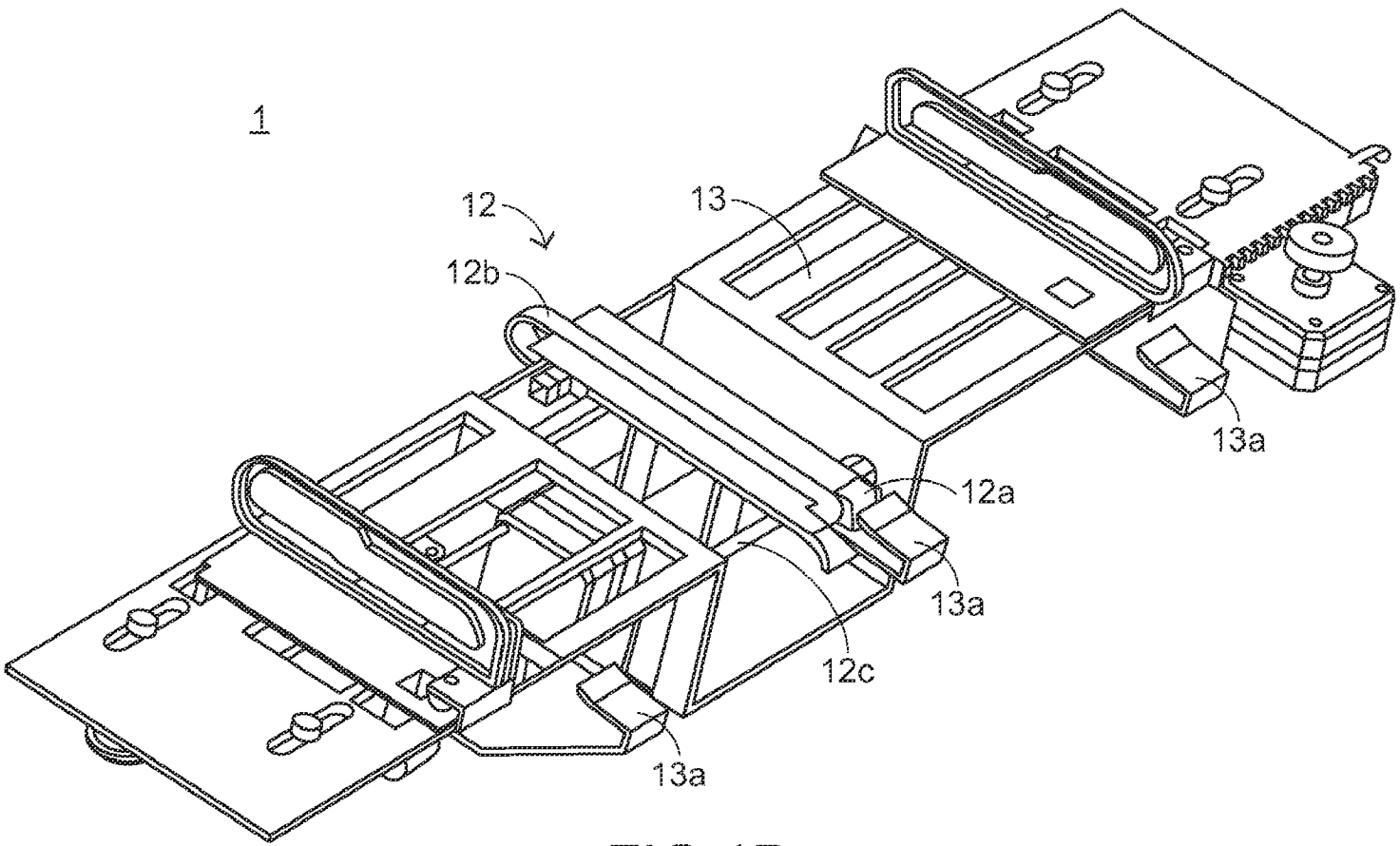
FIG.1D PRIOR ART
FIG. 1D is a schematic perspective view illustrating a sheet ejection device of the conventional sheet alignment and ejection mechanism, in which the sheet ejection device is in a sheet-ejecting status.
Figure 1E:
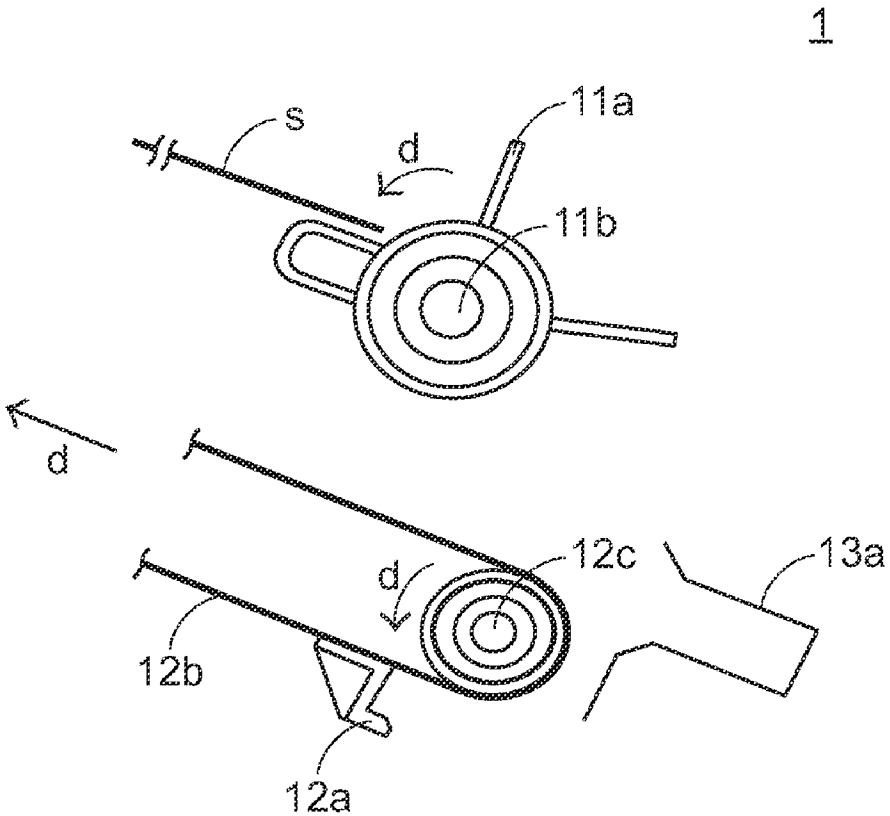
FIG. 1E PRIOR ART
FIG. 1E is a schematic side view illustrating the conventional sheet alignment and ejection mechanism.
Figure 2:
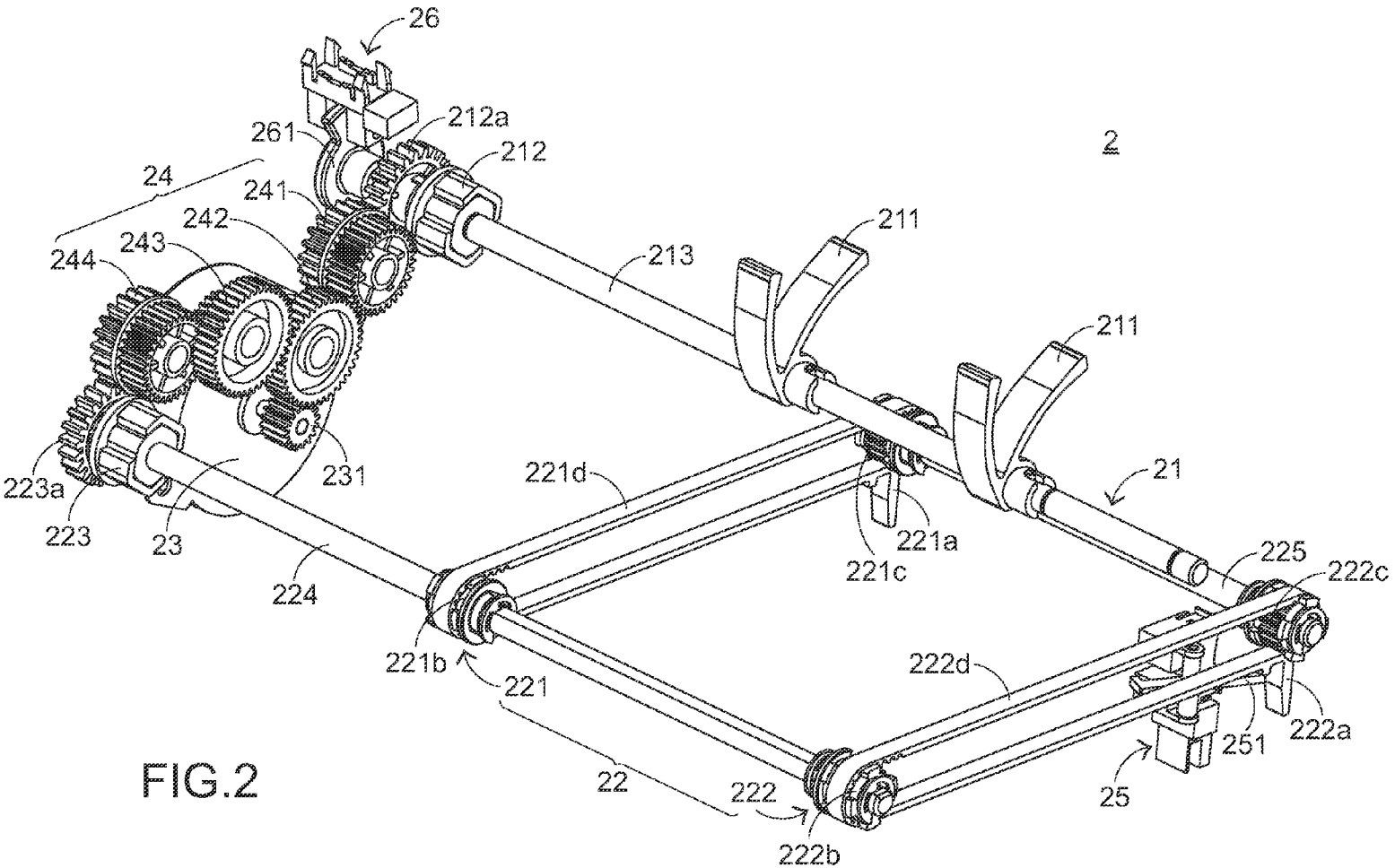
FIG. 2 is a schematic perspective view illustrating a sheet alignment and ejection mechanism according to an embodiment of the present invention.

FIG. 2 is a schematic perspective view illustrating a sheet alignment and ejection mechanism according to an embodiment of the present invention. As shown in FIG. 2, the sheet alignment and ejection mechanism 2 comprises a sheet alignment device 21, a sheet ejection device 22, a power device 23 and a transmission unit 24.

The sheet alignment device 21 comprises two paddles 211, a first one-way element 212 and a first rotation shaft 213. The first one-way element 212 comprises an alignment gear 212*a*. For example, the first one-way element 212 is a one-way clutch. The sheet ejection device 22 comprises a first sheet ejection assembly 221, a second sheet ejection assembly 222, a second one-way element 223, a second rotation shaft 224 and a third rotation shaft 225. The second one-way element 223 comprises a sheet ejection gear 223*a*. For example, the second one-way element 223 is also a one-way clutch. The first sheet ejection assembly 221 comprises a first pushing part 221*a*, a first belt pulley 221*b*, a second belt pulley 221*c* and a first ring-shaped conveyor belt 221*d*. The second sheet ejection assembly 222 comprises a second pushing part 222*a*, a third belt pulley 222*b*, a fourth belt pulley 222*c* and a second ring-shaped conveyor belt 222*d*. The power device 23 comprises a driving gear 231. The transmission unit 24 comprises a first gear 241, a second gear 242, a third gear 243 and a fourth gear 244. The sheet alignment and ejection mechanism 2 further comprises a first sensor 25, a first interrupter 251, a second sensor 26 and a second interrupter 261.

Hereinafter, the sequence of assembling the sheet alignment and ejection mechanism 2 will be illustrated with reference to FIG. 2. Firstly, the first one-way element 212 and the alignment gear 212*a* of the sheet alignment device 21 are sheathed around a first end of the first rotation shaft 213. In addition, the alignment gear 212*a* is coupled with the first one-way element 212. The two paddles 211 are attached on a second end of the first rotation shaft 213. The second one-way element 223 and the sheet ejection gear 223*a* of the sheet ejection device 22 are sheathed around a first end of the second rotation shaft 224. In addition, the sheet ejection gear 223*a* is coupled with the second one-way element 223. The second rotation shaft 224 and the third rotation shaft 225 are parallel with each other. The first belt pulley 221*b* and the third belt pulley 222*b* are sheathed around a second end of the second rotation shaft 224. The second belt pulley 221*c* and the fourth belt pulley 222*c* are sheathed around both ends of the third rotation shaft 225, respectively. The outer peripheries of the first belt pulley 221*b* and the second belt pulley 221*c* are enclosed by the first ring-shaped conveyor belt 221*d*. The third belt pulley 222*b* and the fourth belt pulley 222*c* are enclosed by the second ring-shaped conveyor belt 222*d*. The first pushing part 221*a* and the second pushing part 222*a* are protruded from the outer surfaces of the first ring-shaped conveyor belt 221*d* and the second ring-shaped conveyor belt 222*d*, respectively. The first gear 241 of the transmission unit 24 is engaged with the alignment gear 212*a* of the first one-way element 212 and the second gear 242. The second gear 242 is engaged with the driving gear 231 of the power device 23, the first gear 241 and the third gear 243. The third gear 243 is engaged with the second gear 242 and the fourth gear 244. The fourth gear 244 is engaged with the third gear 243 and the sheet ejection gear 223*a* of the second one-way element 223. The first sensor 25 is disposed beside the second ring-shaped conveyor belt 222*d* of the second sheet ejection assembly 222. The first interrupter 251 is pivotally coupled to the first sensor 25 and protruded under the second ring-shaped conveyor belt 222*d*. The second interrupter 261 is sheathed around the first end of the first rotation shaft 213. The second sensor 26 is disposed over the second interrupter 261.

Figure 3:
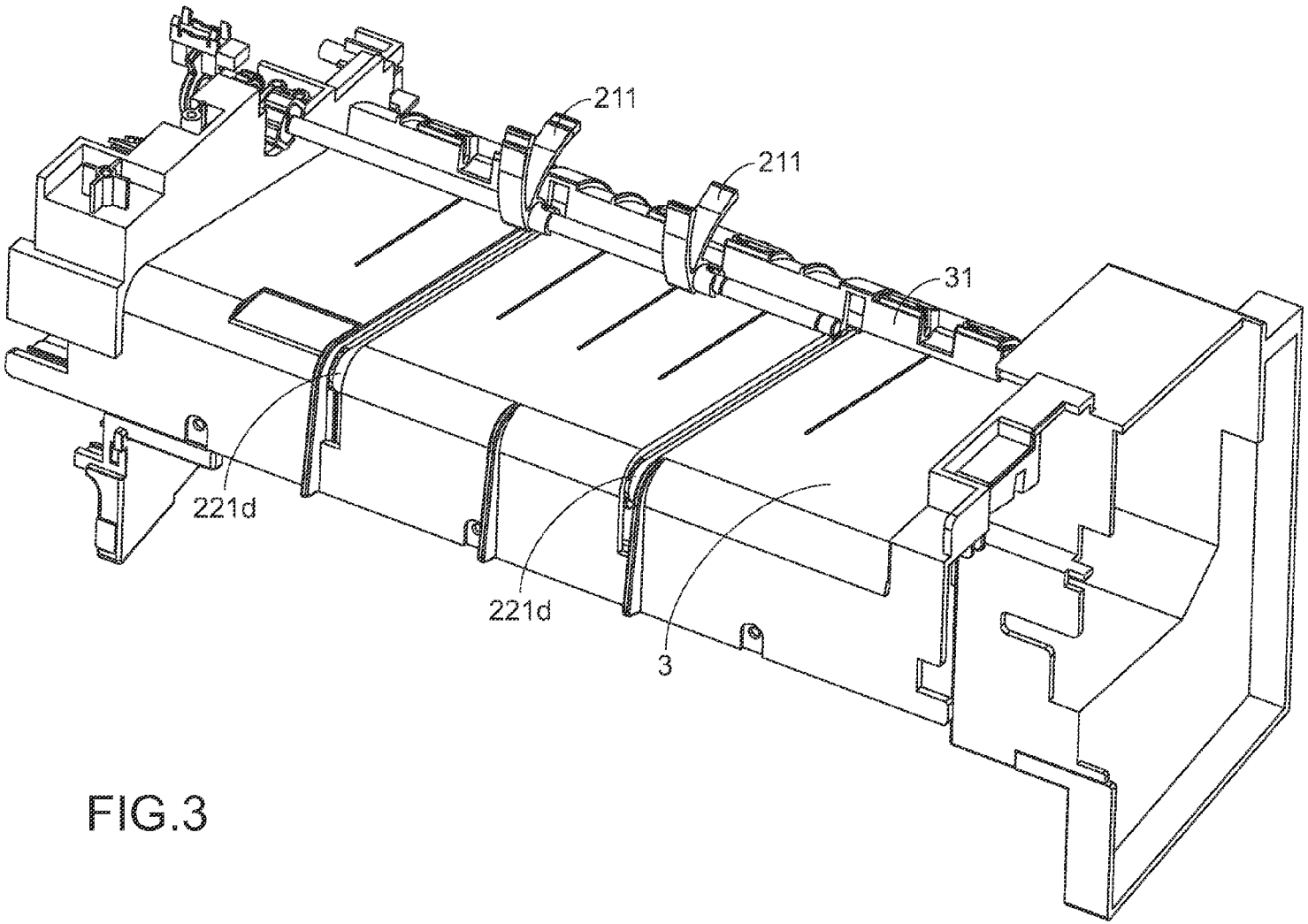
FIG. 3 is a schematic perspective view illustrating the sheet alignment and ejection mechanism applied to an office machine according to the embodiment of the present invention.

Hereinafter, the operations of the sheet alignment and ejection mechanism 2 will be illustrated with reference to FIG. 3. FIG. 3 is a schematic perspective view illustrating the sheet alignment and ejection mechanism applied to an office machine according to the embodiment of the present invention. Before the sheet is introduced to a sheet placement tray 3, and the sheet alignment device 21 and the sheet ejection device 22 are located at the home positions. Consequently, the two paddles 211 of the sheet alignment device 21 are oriented upwardly and distant from the sheet placement tray 3. Under this circumstance, the second interrupter 261 is oriented upwardly to interrupt signal transmission path of the second sensor 26. Meanwhile, the first pushing part 221*a* of the first sheet ejection assembly 221 and the second pushing part 222*a* of the second sheet ejection assembly 222 are disposed under the third rotation shaft 225 and are not protruded from the surface of the sheet placement tray 3. At the same time, the first interrupter 251 is pushed by the second pushing part 222*a*, so that the signal transmission path of the first sensor 25 is not interrupted.

Figure 4A:
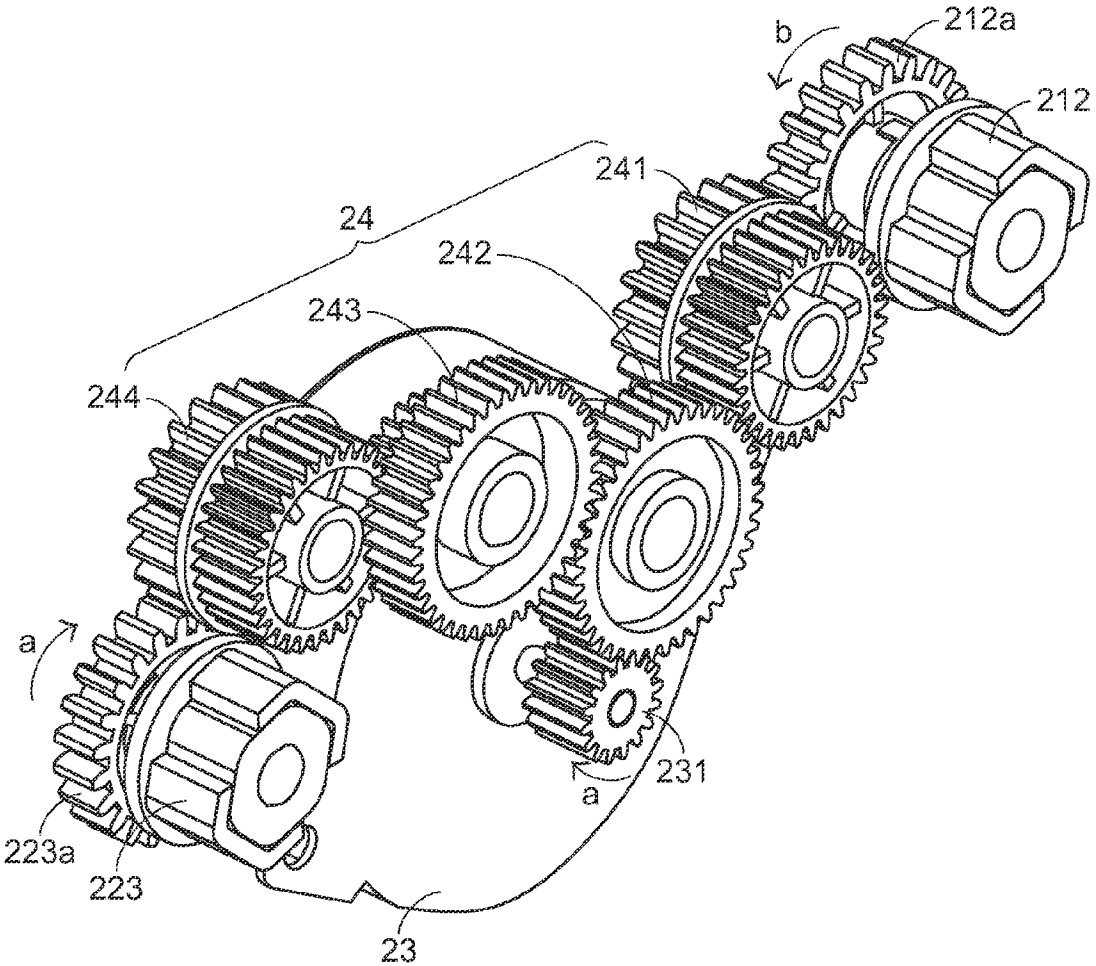
FIG. 4A is a schematic perspective view illustrating the rotating directions of the transmission unit, the power device, the driving gear, the first one-way element, the alignment gear, the second one-way element and the sheet ejection gear of the sheet alignment and ejection mechanism in a sheet-aligning mode according to the embodiment of the present invention.
Figure 4B:
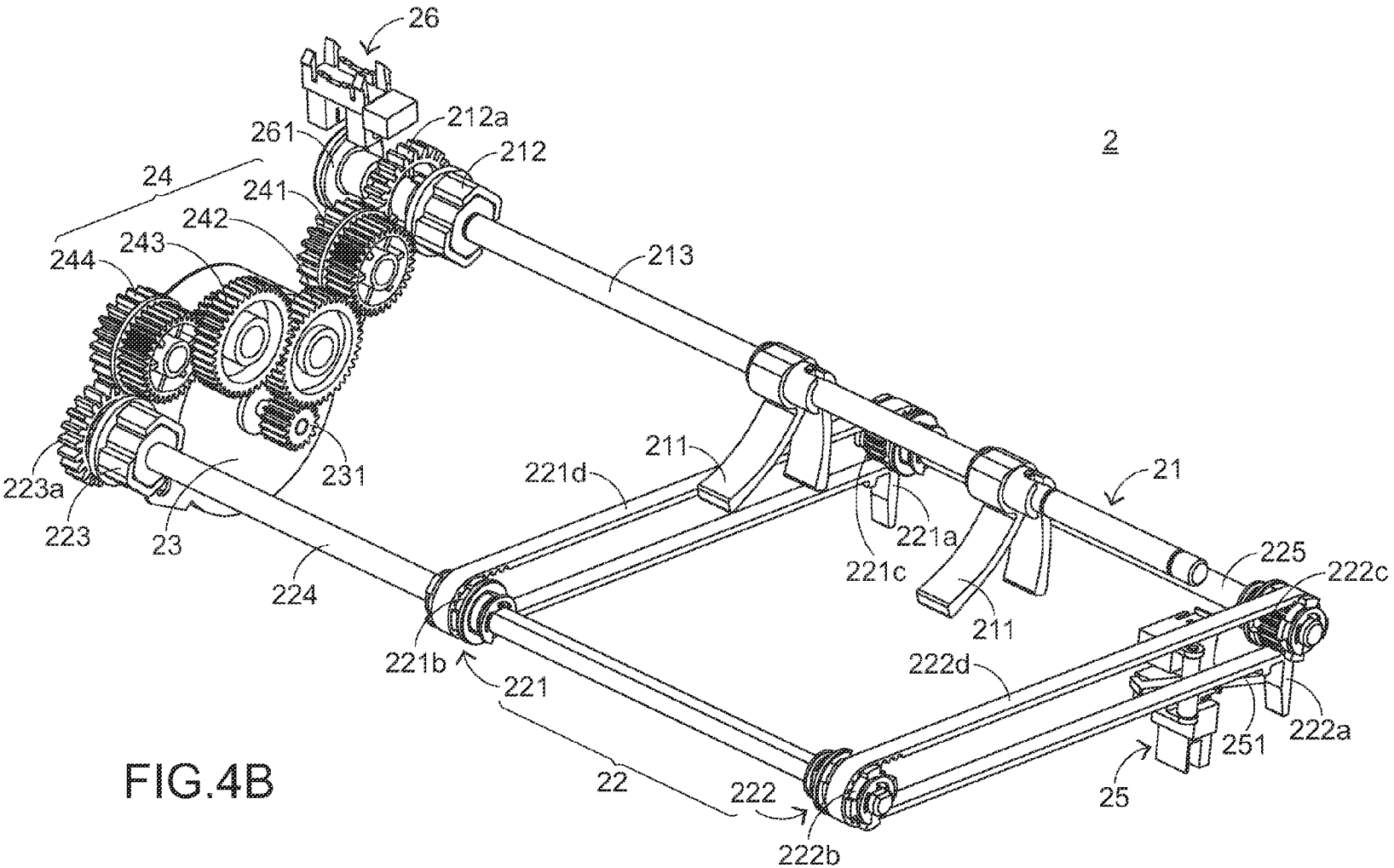
FIG. 4B is a schematic perspective view illustrating the sheet alignment and ejection mechanism in the sheet-aligning mode according to the embodiment of the present invention.

Please refer to FIGS. 4A and 4B. FIG. 4A is a schematic perspective view illustrating the rotating directions of the transmission unit, the power device, the driving gear, the first one-way element, the alignment gear, the second one-way element and the sheet ejection gear of the sheet alignment and ejection mechanism in a sheet-aligning mode according to the embodiment of the present invention. FIG. 4B is a schematic perspective view illustrating the sheet alignment and ejection mechanism in the sheet-aligning mode according to the embodiment of the present invention. After the sheet is introduced to the sheet placement tray 3, the driving gear 231 is driven by the power device 23 to be rotated in the direction a. Due to the linkage through the transmission unit 24, the transmission unit 24 is correspondingly rotated, and thus the alignment gear 212*a* and the first one-way element 212 are rotated in the direction b. As the first one-way element 212 is rotated in the direction b, the first one-way element 212 is not moved relative to the first rotation shaft 213. That is, the first rotation shaft 213 and the two paddles 211 are driven by the first one-way element 212 to be rotated in the direction b. As the two paddles 211 are rotated in the direction b, the sheet on the sheet placement tray 3 will be pushed by the two paddles 211, so that the sheet is leant against a terminal side 31 of the sheet placement tray 3. At the same time, the second interrupter 261 is also rotated in the direction b, so that the signal transmission path of the second sensor 26 is no longer interrupted by the second interrupter 261. After the first rotation shaft 213 is rotated for one turn, the two paddles 211 and the second interrupter 261 are returned to the home position (see FIG. 2). Meanwhile, the signal transmission path of the second sensor 26 is interrupted by the second interrupter 261 again. According to the repeated interrupted status of the signal transmission path of the second sensor 26, a controller (not shown) will judge that a sheet-aligning action of a sheet is completed by the sheet alignment device 21. As the sheet alignment device 21 is continuously operated, the turn number of rotating the first rotation shaft 213 is equal to the number of sheets to be aligned. Until the sheets on the sheet placement tray 3 are aligned with each other, the sheet-aligning actions of these sheets are completed.

One the other hand, when the driving gear 231 is driven by the power device 23 to be rotated in the direction a, due to the linkage through the transmission unit 24, the sheet ejection gear 223*a* and the second one-way element 223 are rotated in the direction a. Since the friction force between the second one-way element 223 and the second rotation shaft 224 is very small at this moment, the second one-way element 223 fails to drive rotation of the second rotation shaft 224. Under this circumstance, since the sheet ejection device 22 is not driven by the power device 23, the sheet ejection device 22 is temporarily disabled.

Figure 5A:
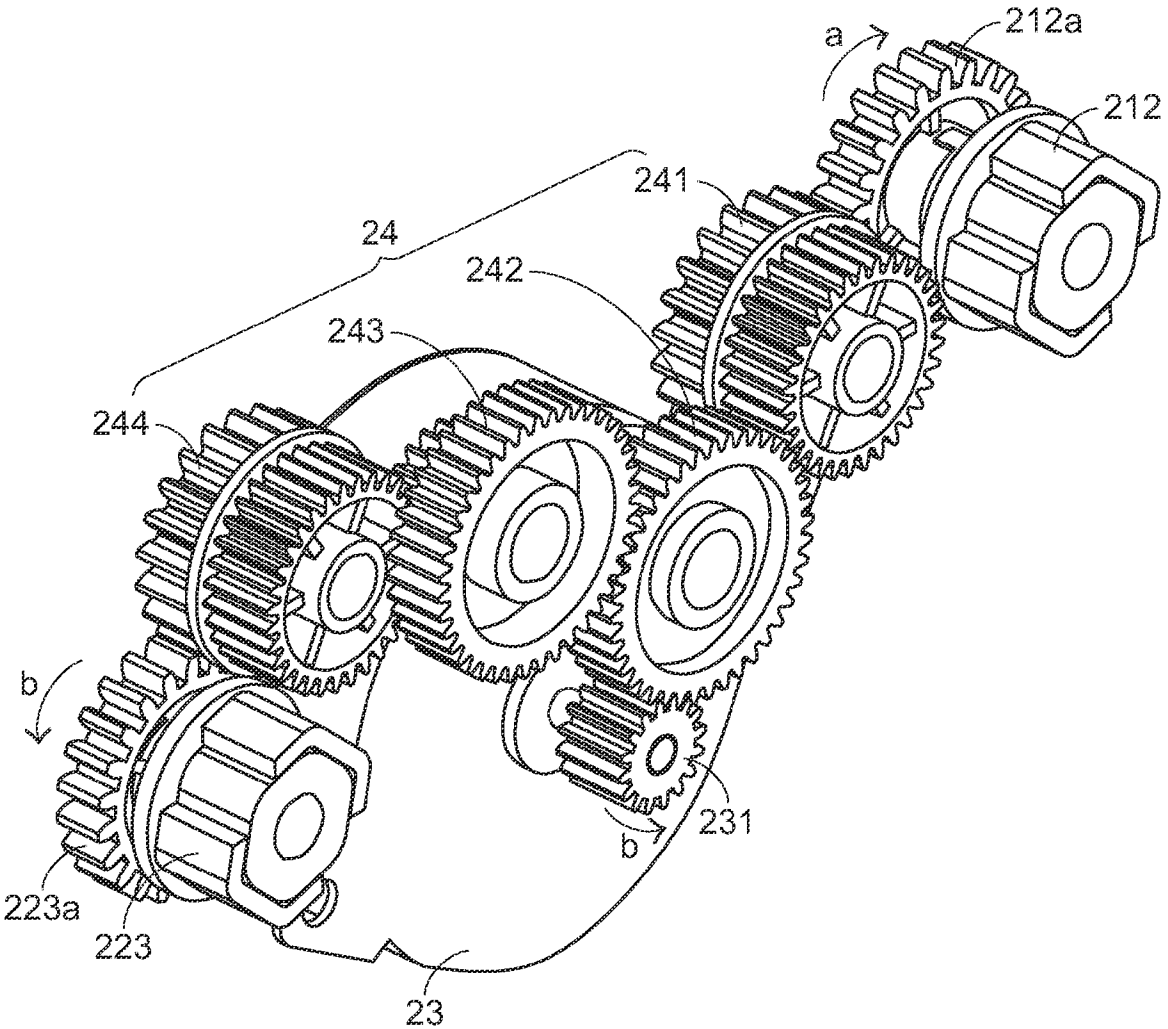
FIG. 5A is a schematic perspective view illustrating the rotating directions of the transmission unit, the power device, the driving gear, the first one-way element, the alignment gear, the second one-way element and the sheet ejection gear of the sheet alignment and ejection mechanism in a sheet-ejecting mode according to the embodiment of the present invention.
Figure 5B:
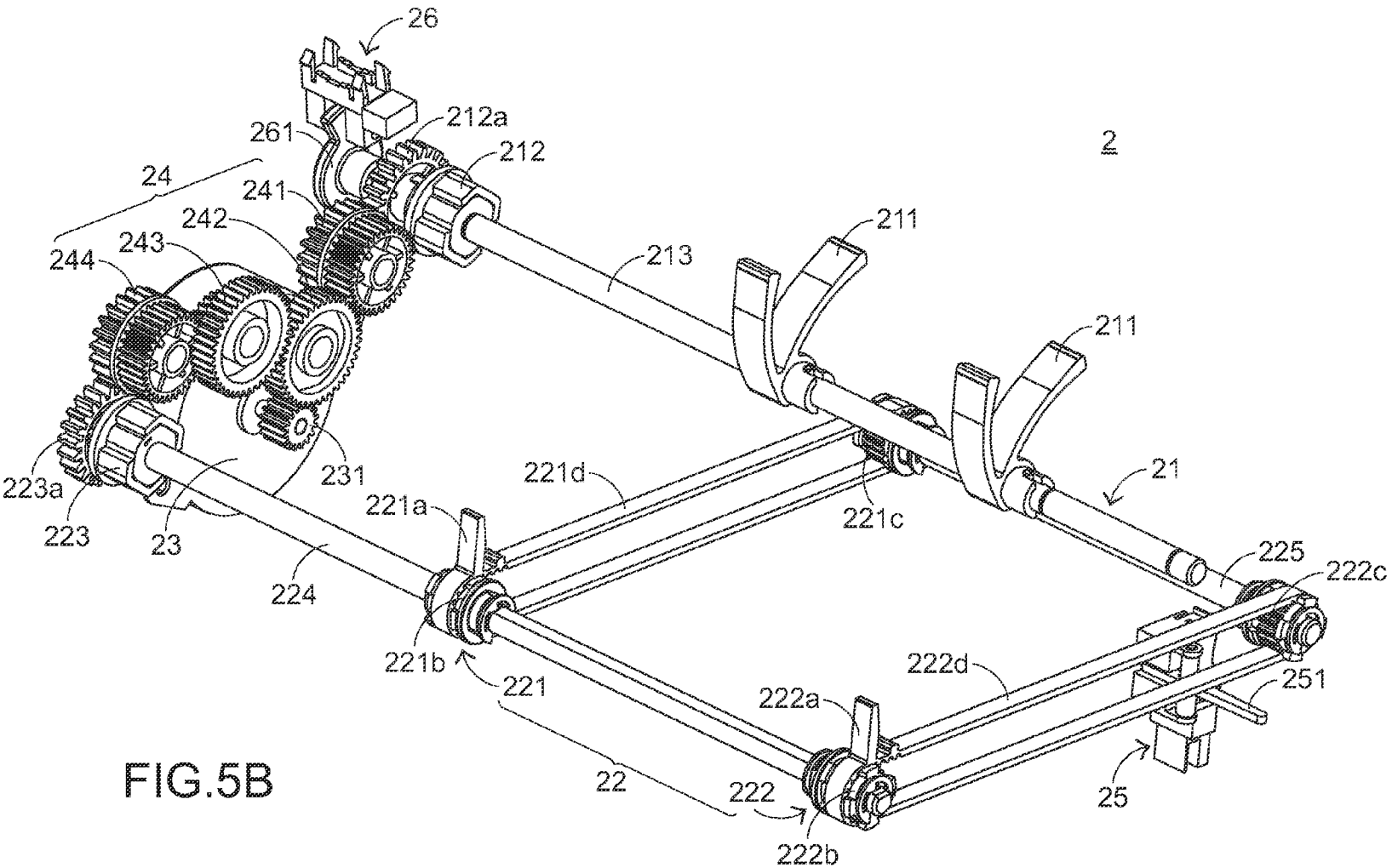
FIG. 5B is a schematic perspective view illustrating the sheet alignment and ejection mechanism in the sheet-ejecting mode according to the embodiment of the present invention.

Please refer to FIGS. 5A and 5B. FIG. 5A is a schematic perspective view illustrating the rotating directions of the transmission unit, the power device, the driving gear, the first one-way element, the alignment gear, the second one-way element and the sheet ejection gear of the sheet alignment and ejection mechanism in a sheet-ejecting mode according to the embodiment of the present invention. FIG. 5B is a schematic perspective view illustrating the sheet alignment and ejection mechanism in the sheet-ejecting mode according to the embodiment of the present invention. After the sheet-aligning actions of the sheets are performed, the sheets on the sheet placement tray 3 are stapled and combined together by a post-processing device such as a stapler (not shown), the stapled sheets are ready to be ejected from the sheet placement tray 3 to the outer portion of the office machine through the sheet ejection device 22. When the sheet ejection operation starts, the driving gear 231 is driven by the power device 23 to be rotated in the direction b. Due to the linkage through the transmission unit 24, the transmission unit 24 is correspondingly rotated, and thus the sheet ejection gear 223*a* and the second one-way element 223 are rotated in the direction b. As the second one-way element 223 is rotated in the direction b, the second one-way element 223 is not moved relative to the second rotation shaft 224. Consequently, the second rotation shaft 224, the first belt pulley 221*b* and the third belt pulley 222*b* are driven by the second one-way element 223 to be rotated in the direction b. As the first belt pulley 221*b* and the third belt pulley 222*b* are rotated in the direction b, the first ring-shaped conveyor belt 221*d* and the second ring-shaped conveyor belt 222*d* are rotated in the direction b, so that the third rotation shaft 225, the second belt pulley 221*c* and the fourth belt pulley 222*c* are also rotated in the direction b. Consequently, the rotation of the first ring-shaped conveyor belt 221*d* and the second ring-shaped conveyor belt 222*d* are rotated more smoothly. When the first pushing part 221*a* and the second pushing part 222*a* are moved upwardly from the position under the third rotation shaft 225 to the surface of the sheet placement tray 3, the first interrupter 251 is no longer pushed by the second pushing part 222*a*, so that the signal transmission path of the first sensor 25 is interrupted. The first pushing part 221*a* and the second pushing part 222*a* are continuously moved along the surface of the sheet placement tray 3 in the direction b. Until the first pushing part 221*a* and the second pushing part 222*a* are moved to the position over the second rotation shaft 224, the stapled sheets are removed from the sheet placement tray 3. After the stapled sheets are removed from the sheet placement tray 3, the first ring-shaped conveyor belt 221*d* and the second ring-shaped conveyor belt 222*d* are continuously rotated in the direction b until the first pushing part 221*a* and the second pushing part 222*a* are moved to the position under the third rotation shaft 225 again. Meanwhile, the first interrupter 251 is pushed by the second pushing part 222*a*, so that the signal transmission path of the first sensor 25 is no longer interrupted. According to the repeated interrupted status of the signal transmission path of the first sensor 25, the controller (not shown) will judge that the sheet ejection operation is completed by the sheet ejection device 22.

One the other hand, when the driving gear 231 is driven by the power device 23 to be rotated in the direction d, due to the linkage through the transmission unit 24, the alignment gear 212*a* and the first one-way element 212 are rotated in the direction a. Since the friction force between the first one-way element 212 and the first rotation shaft 213 is very small at this moment, the first one-way element 212 fails to drive rotation of the first rotation shaft 213. Under this circumstance, since the sheet alignment device 21 is not driven by the power device 23, the sheet alignment device 21 is temporarily disabled.

In the above embodiment, the alignment gear 212*a* of the first one-way element 212, the driving gear 231 of the power device 23 and the sheet ejection gear 223*a* of the second one-way element 223 are connected with each other through the plural gears of the transmission unit 24. Due to the linkage between the first one-way element 212 and the second one-way element 223 through the plural gears of the transmission unit 24, upon rotation of the driving gear 231 of the power device 23, the first one-way element 212 and the second one-way element 223 are rotated in opposite directions. Moreover, the number of gears included in the transmission unit 24 of the sheet alignment and ejection mechanism is dependent on the distance between the first rotation shaft 213 of the sheet alignment device 21 and the second rotation shaft 224 of the sheet ejection device 22. In a case that the distance between the first rotation shaft 213 and second rotation shaft 224 is increased or decreased according to the size of the sheet placement tray 3, the number of gears included in the transmission unit 24 may be correspondingly increased or decreased to meet the practical requirements. In other words, the number of gears included in the transmission unit 24 and the relationships between the plural gears of the transmission unit 24, the alignment gear 212*a* and the sheet ejection gear 223*a* are not restricted to the above embodiment and numerous modifications may be made.

For example, in another embodiment of the sheet alignment and ejection mechanism 2, the relationships between the first gear 241, the second gear 242, the third gear 243 and the fourth gear 244 of the transmission unit 24 are similar to those of the above embodiment but the relationships between the transmission unit 24, the alignment gear 212*a* of the first one-way clutch 212 and the sheet ejection gear 223*a* are distinguished. In this embodiment, the first gear 241 is engaged with the alignment gear 212*a* and the second gear 242, the second gear 242 is engaged with the first gear 241 and the third gear 243, the third gear 243 is engaged with the driving gear 231 of the power device 23, the first gear 241 and the third gear 243, and the fourth gear 244 is engaged with the third gear 243 and the sheet ejection gear 223*a* of the second one-way element 223. In such way, the first one-way element 212 and the second one-way element 223 are also rotated in opposite directions.

From the above description, the sheet alignment and ejection mechanism 2 of the present invention comprises a sheet alignment device 21, a sheet ejection device 22, a power device 23 and a transmission unit 24. The sheet alignment device 21 and the sheet ejection device 22 can be sequentially driven by rotating the single power device 23 in different directions due to the cooperation between the first one-way element 212 and the alignment gear 212*a* of the sheet alignment device 21, the second one-way element 223 and the sheet ejection gear 223*a* of the sheet ejection device 22, the driving gear 231 of the power device 23 and the transmission unit 24. Moreover, since only a single power device is installed in the sheet alignment and ejection mechanism, the layout space is saved and the fabricating cost is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet alignment and ejection mechanism for use in an office machine, said sheet alignment and ejection mechanism comprising:

a sheet alignment device comprising at least one paddle, a first one-way element and a first rotation shaft, wherein said first one-way element comprises an alignment gear, said first one-way element is sheathed around said first rotation shaft, and said paddle is attached on said first rotation shaft, wherein when said first one-way element is rotated in a first direction, said first rotation shaft and said paddle are driven by said first one-way element to be rotated in said first direction, wherein when said first one-way element is rotated in a second direction, said first rotation shaft and said paddle are immobile;

a sheet ejection device comprising at least one sheet ejection assembly, a second one-way element and a second rotation shaft, wherein said second one-way element comprises a sheet ejection gear, and said second one-way element is sheathed around said second rotation shaft, wherein when said second one-way element is rotated in said first direction, said second rotation shaft and said sheet ejection gear are driven by said second one-way element to be rotated in said first direction, wherein when said second one-way element is rotated in said second direction, said second rotation shaft and said sheet ejection gear are immobile;

a power device comprising a driving gear, wherein said driving gear is driven by said power device to be rotated in either said first direction or said second direction; and a transmission unit comprising plural gears, wherein said plural gears are connected with said power device, said first one-way element and said second one-way element for driving rotation of said first one-way element and said second one-way element, wherein said first one-way element and said second one-way element are rotated in opposite directions.

2. The sheet alignment and ejection mechanism according to claim 1 wherein said transmission unit comprises a first gear, a second gear, a third gear and a fourth gear, wherein said first gear is engaged with said alignment gear of said first one-way clutch and said second gear, said second gear is engaged with said driving gear of said power device, the first gear and said third gear, said third gear is engaged with said second gear and said fourth gear, and said fourth gear is engaged with said third gear and said sheet ejection gear of said second one-way element.

3. The sheet alignment and ejection mechanism according to claim 2 wherein when said driving gear is driven by said power device to be rotated in said first direction, said first one-way element is rotated in said second direction and said second one-way element is rotated in said first direction.

4. The sheet alignment and ejection mechanism according to claim 2 wherein when said driving gear is driven by said power device to be rotated in said second direction, said first one-way element is rotated in said first direction and said second one-way element is rotated in said second direction.

5. The sheet alignment and ejection mechanism according to claim 1 wherein said sheet ejection device further comprises a third rotation shaft, and said sheet ejection assembly comprises at least one pushing part, a first belt pulley, a second belt pulley and a ring-shaped conveyor belt, wherein said third rotation shaft is parallel with said second rotation shaft, said first belt pulley and said second belt pulley are respectively sheathed around said second rotation shaft and said third rotation shaft, said pushing part is protruded from an outer surface of said ring-shaped conveyor belt, and outer peripheries of said first belt pulley and said second belt pulley are enclosed by said ring-shaped conveyor belt.

6. The sheet alignment and ejection mechanism according to claim 5 further comprising a first sensor and a first interrupter, wherein said first sensor is disposed beside said ring-shaped conveyor belt of said sheet ejection assembly, and said first interrupter is pivotally coupled to said first sensor and protruded under said ring-shaped conveyor belt, wherein said first sensor and said first interrupter are collectively operated to detect whether said pushing part is at a home position.

7. The sheet alignment and ejection mechanism according to claim 1 further comprising a second sensor and a second interrupter, wherein said second interrupter is sheathed around said first rotation shaft, and said second sensor is disposed over said second interrupter, wherein said second sensor and said second interrupter are collectively operated to detect the number of times said first rotation shaft of said sheet alignment is rotated.

8. The sheet alignment and ejection mechanism according to claim 1 wherein said first one-way element and said second one-way element are one-way clutches.

* * * * *